US006027412A

United States Patent [19]

Pinel et al.

[11] Patent Number: 6,027,412

[45] Date of Patent: Feb. 22, 2000

[54] BOWLING BALL

[75] Inventors: Maurice L. Pinel, Hampton; Richard W. Sadles, Poquoson, both of Va.

[73] Assignee: Morich Enterprises, Inc., Grafton, Va.

[21] Appl. No.: 09/135,695

[22] Filed: Aug. 18, 1998

[51] Int. Cl.[7] ..... A63B 37/06

[52] U.S. Cl. ..... 473/126; 273/DIG. 20

[58] Field of Search ..... 473/125, 126, 473/130; 273/DIG. 20

[56] References Cited

U.S. PATENT DOCUMENTS

| | | | |
|---|---|---|---|
| 507,880 | 10/1893 | Burt | 156/228 |
| 3,350,252 | 10/1967 | Twickler | 273/63 |
| 3,400,929 | 9/1968 | Fabanich | 273/63 |
| 4,913,429 | 4/1990 | Fabanich | 273/63 E |
| 5,037,096 | 8/1991 | Pinel, Jr. et al. | 273/63 E |
| 5,125,656 | 6/1992 | Fabanich | 273/63 E |
| 5,215,304 | 6/1993 | Pinel, Jr. et al. | 273/63 E |
| 5,257,806 | 11/1993 | Linden | 473/126 |
| 5,389,042 | 2/1995 | Pinel, Jr. et al. | 473/126 |
| 5,462,491 | 10/1995 | MacDonald | 473/126 |
| 5,522,774 | 6/1996 | Cardinale et al. | 473/125 |

*Primary Examiner*—William M. Pierce

*Attorney, Agent, or Firm*—Schweitzer Cornman Gross & Bondell LLP

[57] ABSTRACT

A bowling ball includes an inner weight block surrounded by the bowling ball shell. The weight block has a body, head and tip portions. The central x axis for the body is offset from the X axis of the ball, while the centered x axes for the head and tip portions are aligned with the X axis of the ball. A ball with such a construction exhibits increased torque which manifests itself as a sharp hook deep into the roll, while the initial trajectory is relatively straight.

4 Claims, 2 Drawing Sheets

BOWLING BALL

The present invention relates to a new and improved bowling ball which exhibits high stability of roll with increased sharpness of hook.

BACKGROUND OF THE INVENTION

Proficient and experienced bowlers require a bowling ball which is capable of controlled departure from a generally straight-line trajectory down the lane. It is well known that, for maximum pin fall and "action", the ball should not approach the pins along a straight path from the bowler, but rather should engage the pins through a curved path. To accomplish this end, a torque or spin is established on the bowling ball. The use of a non-symmetrical core or weight block within the bowling ball results in an increased torque being generated by the ball spin, which torque results in a deviation from a straight line path for the ball and thus the desired curved approach down the lane. Various weight blocks, and positioning of the weight blocks within the ball, as exemplified by the disclosures of U.S. Pat. Nos. 5,037,096; 5,215,304; and 5,389,042 to the present inventors are illustrative of various approaches taken to provide bowling balls having particular torque and roll characteristics which are of value to the experienced bowler.

It is a purpose of the present invention to provide a new and improved bowling ball having a weight block configuration which generates rolling characteristics which are of value to the experienced bowler.

BRIEF DESCRIPTION OF THE INVENTION

The bowling ball of the present invention comprises a weight block of a first density surrounded by on or more spherical outer shells of a different density or densities. The weight block comprises head, body and tip portions, the central vertical axis of the body being offset from the x axis of the ball. Central vertical axes of the head and tip are aligned with the x axis of the ball. The offset of the body from the x axis produces an eccentricity during roll which generates an increased torque which is expressed as a sharp hook deep into the roll, while maintaining a relatively straight trajectory for the initial portions of the roll.

BRIEF DESCRIPTION OF THE DRAWINGS

A fuller understanding of the present invention will be achieved upon consideration of the following detailed description of a preferred, but nonetheless illustrative embodiments of the present invention when reviewed in association with the annexed drawings, wherein.

DETAILED DESCRIPTION OF THE INVENTION

Figure 1:
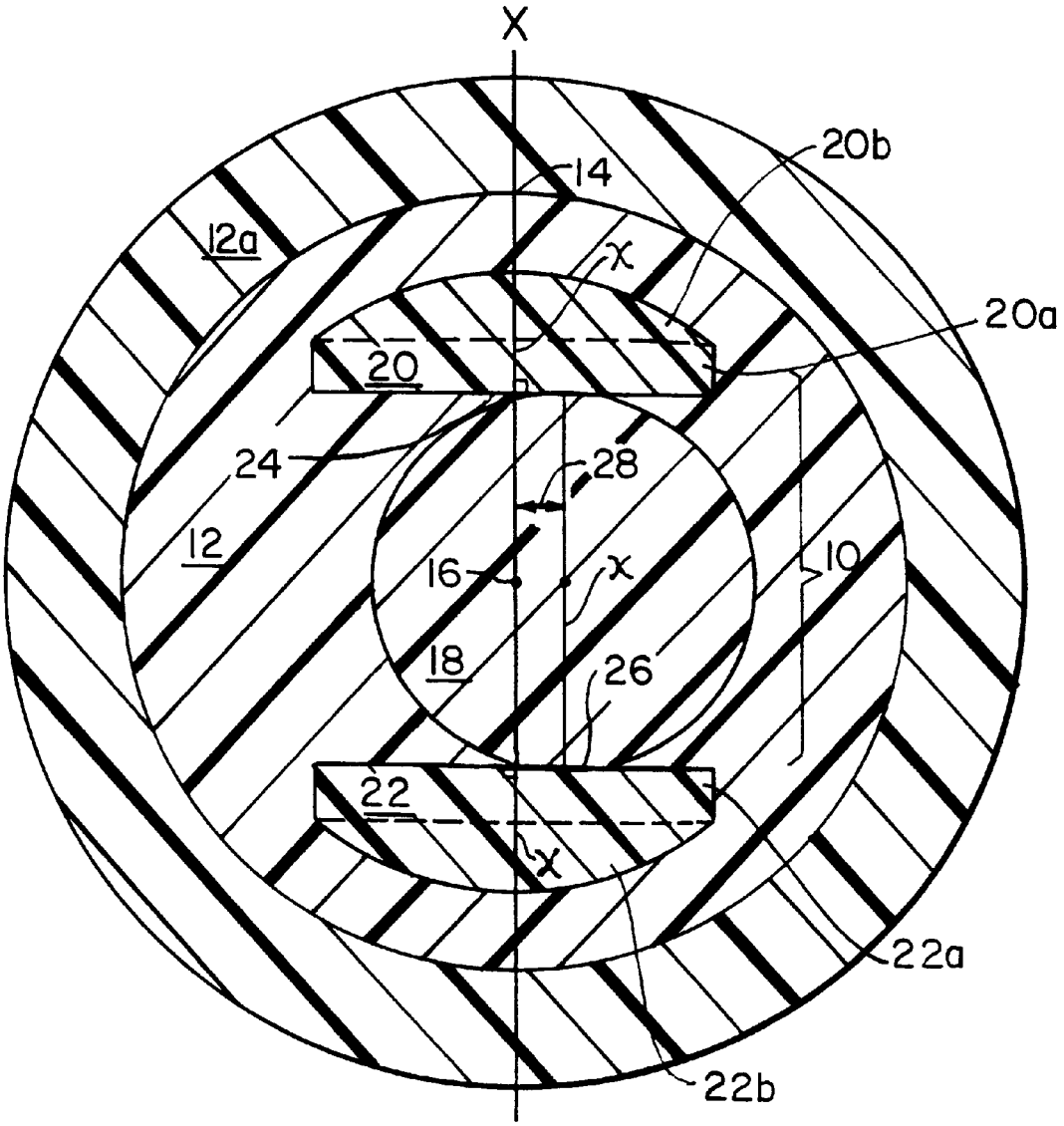
FIG. 1 is a cross-sectional view in elevation of a bowling ball constructed in accordance with the present invention.

With initial reference to FIG. 1, the bowling ball of the present invention comprises a weight block 10 surrounded by a shell 12. A second shell 12*a* may further surround the shell 12 if shall 12 does not comprise the full ball diameter. Shells 12 and 12*a* may be of the same or different densities and/or physical characteristics, using materials as known in the art. The weight block may be formed out of either discrete elements or a unitary mass of an appropriate compound, typically a polyester or a urethane as known in the art. The combination of the weight block and shells are compounded to fall within the 16 pound weight limit for commercial balls.

As known in the art, the bowling ball is provided with a major X axis 14 extending through the geometric center 16 of the ball. the X axis is defined by the American Bowling Congress as the axis about which exists the lowest moment of inertia. The weight block 10 is generally aligned along this X axis, and is divided into three portions; a central body 18, a head 20 at a first end of the body and a tip 22 at a second end of the body. The head and body are joined along plane 24 while the tip and body are joined along plane 26. Each of the joining planes 24, 26 are perpendicular to the X axis of the ball and to a central vertical axis x for the block portions. The body, head and tip may be formed as an integral mass, all of the same density, or each may individually formed from a composition of a different density, the portions being bonded together as known in the art. It is preferred that the body be of uniform density.

Each of the central vertical axes of the body, head and tip portions is co-linear with the X axis of the ball. The central vertical axes of the head 20 and tip 22 are aligned with the X axis of the ball, while the central vertical axis of the body 18 is offset from the ball X axis by a distance 28. Each of the central vertical axes x lies along the center of inertia or mass for the portion about an axis perpendicular to the joining planes 24, 26. Thus the block portions may be either symmetrical or asymmetrical in plan, the portion's x axis being located as required by the geometry of the portion.

As depicted in FIG. 1, head 20 and tip 22 each may be in the form of a respective cylindrical portion 20*a*, 22*a* capped with a portion of a sphere 20*b*, 22*b*. Both head and tip 20 and 22 may be formed of material of the same density, such density being either the same or different than the density of body portion 18. The average density of the head and tip portions of the weight block, however is greater than that of the surrounding shells 12. The densities may be varied as desired in accordance with the roll characteristics desired, so long as ABC requirements for the radius of gyration and differential radius of gyration for the ball are met.

A ball in accordance with FIG. 1 may be constructed with the following characteristics. With a ball volume of 5344 cc, the weight block has a volume of 870 cc. The head 20 has a volume of 180 cc, and a density of 2.20 g/cc. The tip 22 is of the same volume, and has a density of 1.80 g/cc. The body 18 has a volume of 510 cc, and a density of 3.0 g/cc. The body offset 28 from the ball X axis is of the range of 0.250 to 0.300 inch. The length of the weight block along the X axis is 5.90 inches in a ball of standard diameter of 8.5 inches.

Alternatively, the two portions of the head 20*a,b* and tip 22*a,b* may be of different densities to change the moment of inertia about the center of the ball. The head portion 20*a*, which may have a volume of 110 cc, may have a density of 3.0 g/cc while the portion 20*b*, with a volume of 70 cc, may have a density of 4.0 g/cc. Such a formulation increases the offset between head and tip masses, and places the effective center of mass of the head farther away from the center of the ball, further emphasizing ball eccentricity.

Figure 2:
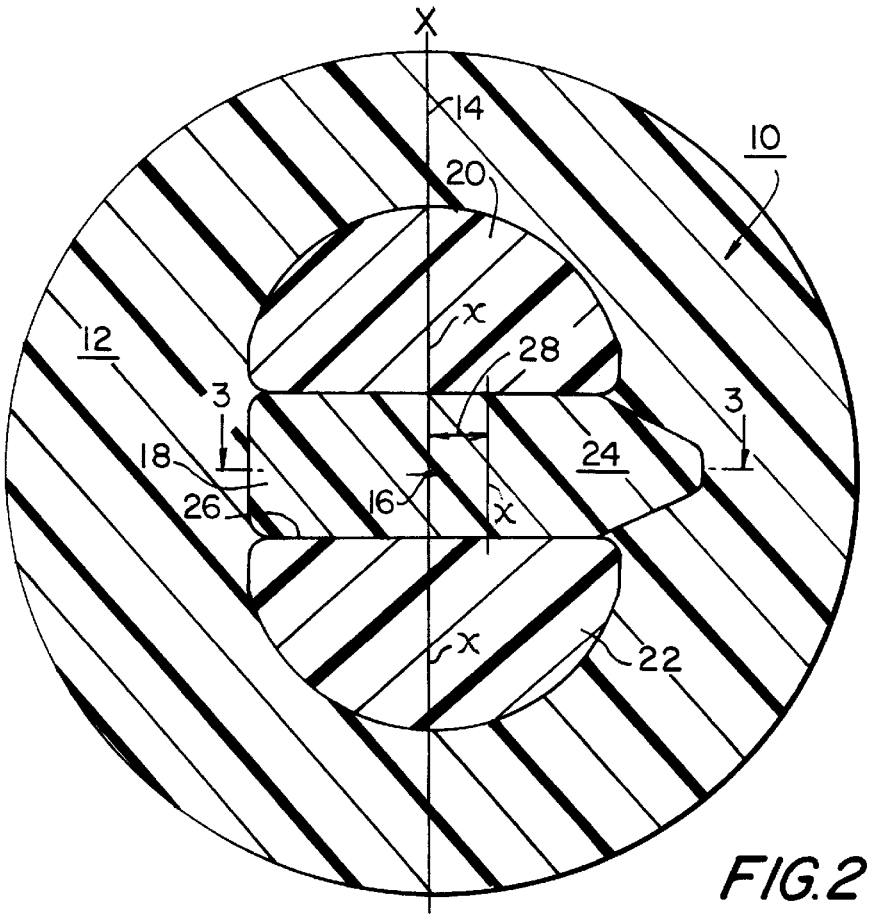
FIG. 2 is a cross-sectional view in elevation of an alternative embodiment thereof.
Figure 3:
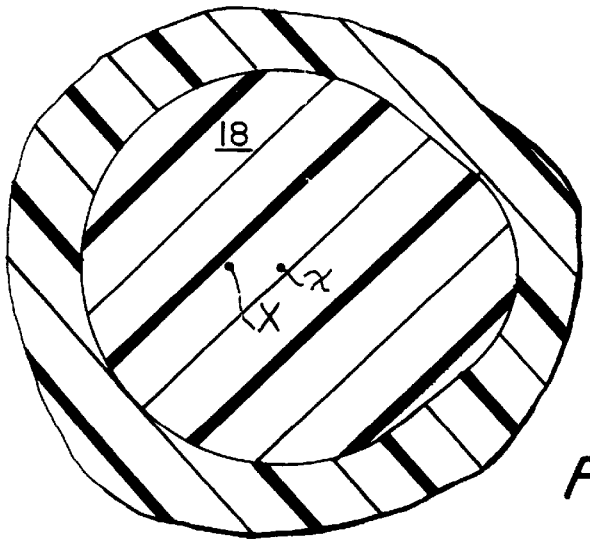
FIG. 3 is a sectional view of the body portion of the weight block of FIG. 2 taken along line 3—3 therein.

FIGS. 2 and 3 depicts an alternative embodiment for the invention in which the body portion of the weight block is asymmetrical in plan, as seen in FIG. 3. The vertical axis x for the body, however, remains at the center of inertia of rotation about an x axis. Because of the asymmetrical nature of the body, ball rotation about any ball axis other than the X axis will induce wobble effects, unstable motion which increases skid and delays roll which increases ball "action" and play as it travels down the lane.

We claim:

1. A bowling ball, comprising a weight block surrounded by a bowling ball shell, the weight block comprising a central body portion having first and second parallel ends perpendicular to an X axis of the ball, a head portion projecting from the first end of the body and a tip portion projecting from the second end of the body, each of said body, head and tip having a central vertical axis collinear with the X axis of the ball and perpendicular to the parallel body ends, an average density of said head and tip each being greater than the density of the bowling ball shell, the central vertical axis of a body of a weight block being offset from the X axis of the bowling ball, the central vertical axes of both said head and said tip being substantially aligned with the X axis of the ball.

2. The bowling ball of claim 1 wherein said body, head and tip are each symmetrical about its respective central vertical axis.

3. The bowling ball of claim 1 wherein at least one of the head and tip comprise portions of differing densities.

4. The bowling ball of claim 1 wherein at least one of the body, tip and head porions are asymmetrical about its respective central vertical axis.

* * * * *

UNITED STATES PATENT AND TRADEMARK OFFICE

CERTIFICATE OF CORRECTION

PATENT NO. : 6,027,412

DATED : February 22, 2000

INVENTOR(S) : Maurice L. Pinel, et al.

It is certified that error appears in the above-indentified patent and that said Letters Patent is hereby corrected as shown below:

Claim 1, line 11

"a body" should read --the body--;

"a weight block" should read --the weight block--.

Signed and Sealed this

Tenth Day of April, 2001

*Attest:*

Nicholas P. Godici

NICHOLAS P. GODICI

*Attesting Officer*

*Acting Director of the United States Patent and Trademark Office*